US005201363A

United States Patent [19]

Demarez et al.

[11] Patent Number: 5,201,363

[45] Date of Patent: Apr. 13, 1993

[54] METHOD AND DEVICE FOR MANUFACTURING A SEMI-FERRITIC STAINLESS STEEL STRIP FROM MOLTEN METAL

[75] Inventors: Philippe Demarez, Labeuvriere; Jean-Michel Hauser, Ugine, both of France

[73] Assignees: Usinor Sacilor, Puteaux, France; Thyssen Stahl Aktiengesellschaft, Duisburg; Thyssen Edelstahlwerke AG, Krefeld, both of Fed. Rep. of Germany

[21] Appl. No.: 743,891

[22] Filed: Aug. 12, 1991

[30] Foreign Application Priority Data

Aug. 13, 1990 [FR] France ..... 90 10304

[51] Int. Cl.[5] ..... B22D 11/06; B22D 11/124

[52] U.S. Cl. ..... 164/480; 164/486

[58] Field of Search ..... 164/428, 480, 444, 486

[56] References Cited

U.S. PATENT DOCUMENTS 3,658,117 4/1972 Fromson ..... 164/486
4,823,860 4/1989 Lauener ..... 164/428

FOREIGN PATENT DOCUMENTS 61-293638 12/1986 Japan ..... 164/428

OTHER PUBLICATIONS

Japanese Abstracts, vol. 14, No. 87 (M-937)(4030), Feb. 19, 1990 JPA 1299745, Dec. 4, 1989, Atsushi Hirata, et al. "Method for Casting Austenitic Stainless Steel by Twin Roll Type Continuous Casting Machine".

Japanese Abstracts, vol. 11, No. 326 (C-454)(2773), Oct. 23, 1987; JPA 62-112751 May 23, 1987, Hiroo Suzuki, et al. "Manufacturer of Ferrous Shape Memory Alloy Sheet Metal Or Wire".

Japanese Abstracts, vol. 12, No. 45 (M-667)(2892), Feb. 10, 1988, JPA 62-197247, Aug. 31, 1987, Takeya Toge, et al. "Production of Thin Autstenitic Stainless Steel Strip".

*Primary Examiner*—Kuang Y. Lin

*Attorney, Agent, or Firm*—Oblon, Spivak, McClelland, Maier & Neustadt

[57] ABSTRACT

The method comprises effecting the solidification of the metal in a continuous casting ingot mould constituted by two cooled rolls (2) rotating in opposite directions and disposed in confronting relation so as to define a casting space therebetween, continuously extracting from the ingot mould a solidified steel strip (3), and, below the ingot mould, subjecting the strip to a quenching medium (6) so as to cool it sufficiently rapidly to prevent formation of austenite. This medium may be formed by a quenching bath placed in a container (4) disposed under the rolls (2) and having a bottom provided with an opening (5) for the passage of the solidified strip (3). The quenching medium may also be formed by an inert gas in the liquid state blown onto the product by nozzles. The steel strips obtained are easier to shear and coiled at the output end of the casting line owing to the absence of martensite in the ferritic matrix.

7 Claims, 1 Drawing Sheet

METHOD AND DEVICE FOR MANUFACTURING A SEMI-FERRITIC STAINLESS STEEL STRIP FROM MOLTEN METAL

The present invention relates to a method and device for manufacturing a semi-ferritic stainless steel strip from a bath of molten metal.

More particularly, the invention concerns a two-roll device for the continuous casting of semi-ferritic stainless steel into a thin strip.

It will be recalled that the term "semi-ferritic" signifies that the ferritic structure, whose space lattice is body-centred cubic, is liable to transform at high temperature (900°-1100° C.) partly into an austenitic structure whose space lattice is face-centred cubic.

As is known, the methods and devices for the continuous casting of thin steel strips are still in the experimental stage. The metal is solidified in a continuous casting ingot mould formed by two cooled rolls rotating in opposite directions and disposed in confronting relation, with their axes parallel, at a given distance apart, thereby defining therebetween a casting space closed at the opposite ends of the rolls by closing plates.

Bearing in mind the rate of the air cooling of solidified steel strips continuously extracted from the casting space, it is found that, if it is desired to cast semi-ferritic stainless steel strips, austenite is formed in the course of the cooling. The austenite, which is initially absent from the ferritic monophase structure, is transformed at the end of the cooling into hard martensite. More precisely, and for example as concerns semi-ferritic grades containing 17% Cr and about 0.050% C, while during and just after the solidification, the structure of the steel is ferritic monophase, austenite appears in the course of the cooling in a maximum proportion of 40 to 50%. The resulting martensite following on the transformation of the austenite is a very hard phase relative to the surrounding ferrite.

This heterogeneous structure gives rise to difficulties of handling and deformation of the metal in the course of the rolling up and the unrolling of the strip, and of the direct cold rolling of the as-cast structure, in particular difficulties in the shearing and the coiling of the strips leaving the casting line. Another drawback resulting from this casting method resides in the fact that the strip leaving the ingot mould undergoes a surface oxidation in contact with the surrounding air.

The installation described in the document EP-181 090 comprises a device for cooling a strip, for example of an Fe-Si alloy, cast between two rolls located just before a device for rolling and coiling said strip. However, it is in no way adapted to the casting of semi-ferritic stainless steel, since, on one hand, this cooling device is placed far beyond the ingot mould and, on the other hand, it employs as cooling medium a gas or a mist imposing only a relatively moderate cooling rate on the strip.

An object of the invention is therefore to provide a method and device which overcome these shortcomings.

The invention provides a method comprising effecting the solidification of the metal in a continuous casting ingot mould comprising two cooled rolls rotating in opposite directions and disposed in confronting relation so as to define a casting space therebetween, continuously extracting a strip of solidified steel from the ingot mould, and, below the ingot mould, subjecting said strip to a quenching medium so as to rapidly cool it for a sufficient period of time to prevent formation of austenite.

Preferably, the cooling is at a minimum rate of 300° C./s down to a temperature of the cast strip of about 500° C.

By very rapidly cooling from a temperature higher than the limit temperature of the existence of the austenite (temperature which is usually of the order of 1,200° to 1,250° C. for the considered grades), and lower than the temperature of the end of the solidification, it is indeed found that it is possible to freeze the ferritic structure and prevent the formation of austenite.

By also cooling the strip just below the casting rolls, advantage is taken of the quenching effect on the skin of the metal by the conductive material of the casting rolls, the strip being cooled from a temperature higher than the temperature at which austenite appears in the ferritic matrix.

In a first manner of carrying out the invention, there is employed as the quenching medium a bath of a molten alloy based on lead, tin and zinc, or on two of these metals, or a bath of a single one thereof, or a molten-salt, in which the lower part of the rolls and the upper part of the strip are immersed, and said quenching medium is prevented from being drawn along by the travelling strip, for example by blowing jets of fluid onto the strip as it emerges from the quenching bath or by employing electromagnetic fields.

The molten salt may be advantageously the following mixture (% by weight):

50 to 60% $KNO_3$
40 to 50% $NaNO_2$
0 to 10% $NaNO_3$.

This mixture melts at around 140° C. and may be used between 160° and 500° C.

In a second manner of carrying out the method according to the invention, there is employed as quenching means an inert gas cooled to the liquid state and blown onto the upper part of the strip on opposite sides thereof and under the rolls.

The device for carrying out this method comprises a continuous casting ingot mould comprising two cooled rolls rotating in opposite directions and disposed in confronting relation so as to define a casting space therebetween, and quenching means for subjecting the solidified steel strip, below the ingot mould, to a sufficiently rapid cooling to prevent the formation of austenite. Preferably, these means permit ensuring a cooling at a minimum rate of 300° C./s, at least down to a temperature of the cast strip of about 500° C.

Further features and advantages of the invention will be apparent from the following description, with reference to the accompanying drawings which illustrate two embodiments of the invention by way of non-limitative examples.

Figure 1:
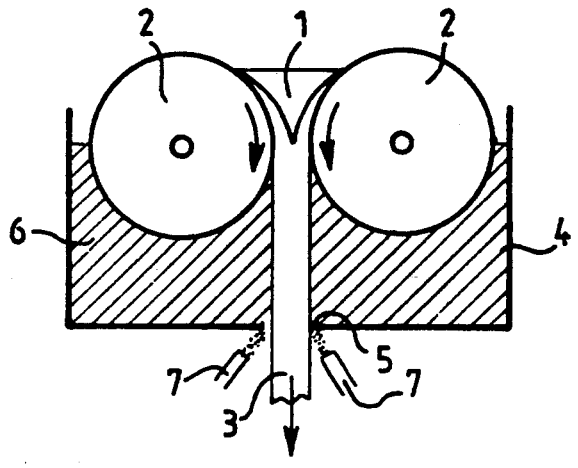
FIG. 1 is a diagrammatic and elevational view of a device for the continuous casting of a strip of metal between two rolls, equipped with a container placed under the rolls and containing a bath of a liquid for quenching the strips extracted from the device.

With reference to FIG. 1, there is shown a device for the continuous casting of a bath of liquid metal 1 between two rolls disposed horizontally and parallel to each other so as to define therebetween a space for the casting of a solidified thin strip 3. This device constitutes a continuous casting ingot mould, the rolls 2 being cooled and driven in rotation in opposite directions indicated by the arrows in FIG. 1, by means known per se (not shown).

In order to permit more particularly the manufacture of semi-ferritic stainless steel strips 3, the device is completed by a container 4 placed under the rolls 2, the bottom of this container being provided in its central region with an opening 5 for the passage of the strip 3, and the container containing a bath of liquid 6 for quenching the strip 3. The dimensions of the container 4 and the level of the bath 6 in the latter are such that the lower part of the rolls 2 and the upper part of the continuously travelling strip 3 are immersed in the bath 6.

The bath of liquid 6 must be at a temperature not exceeding about 300° to 350° C. into which the strip 3 at about 1,300° C. is therefore suddenly plunged. Further, the bath 6 must be chosen from a material which does not pollute the strip 3 in an unacceptable manner.

As non-limitative examples, it is thus possible to employ a quenching bath formed by a molten alloy of lead, zinc and tin or two of these metals, or a bath of a single one thereof. A molten salt, such as the aforementioned mixture of sodium and potassium salts, may also be employed.

The casting device further comprises means for retaining the quenching liquid drawn along by the strip 3 in motion. In the illustrated embodiment, these means comprise two rows of nozzles 7 placed under the bottom of the container 4 on opposite sides of the strip 3 and oriented toward the intersection between the strip and the opening 5 for blowing a fluid onto the surface of the strip 3 as it emerges from the container 4. The fluid may be water at ambient temperature (for example 20° C.) or an atomized water-air mixture blown at a sufficient rate to retain the liquid of the bath 6 inside the container 4.

As a numerical example, this rate may be 50 cu.m/h for a linear velocity of the strip 3 of the order of 1 m/s corresponding to rolls 2 having a diameter of 1.50 m rotating at less than one quarter of a revolution/second. In order to avoid the formation of austenite in the strip 3 in the course of its cooling, the strip must be cooled from 1,300° C. to about 500° C. at a rate of 300° C./s. Now, the aforementioned baths permit a cooling rate of about 2,700° C./s.

Consequently, in respect of a 3.5 mm thick strip travelling at 1 m/s, the appropriate height of the bath 6 travelled through by the strip 3 may be about 40 cm, so that the strip 3 emerges from the bath at about 500° C.

It will be understood that it is unnecessary for the strip to emerge from the quenching bath through the bottom of the container. Inside the bath, the strip may be deviated, for example by rollers, so as to leave the bath in passing through the surface of the latter. Such an arrangement has for effect, for a given depth of the bath, to increase the time during which the strip stays in the bath relative to the previously-described arrangement.

Laboratory tests have been carried out in respect of the following stainless steel grades: AISI 430 (standard ASTM A176) for studying the possible precipitation of austenite and its transformation into martensite; AISI 304 (standard ASTM A167) for estimating the cooling rates: the fineness of the dendritic structure of the solidification of an austenitic steel can be foreseen by a metallographic etching and may be related to the cooling conditions. Results of the tests carried out with specimens of these grades of steel at a quenching temperature of 1,500° C. in a bath of liquid tin 6 at 300° C. cooled within about 0.45 second, to a temperature of 500° C., are the following:

the grade AISI 430 has a ferritic structure containing very little martensitic phase (less than 1%), the cooling rate estimated from the size of the structure of the austenitic grade AISI 304 is between 5,000° C./s and 15,000° C./s.

These tests have therefore confirmed the validity of the method according to the invention for attaining the desired objective.

Figure 2:
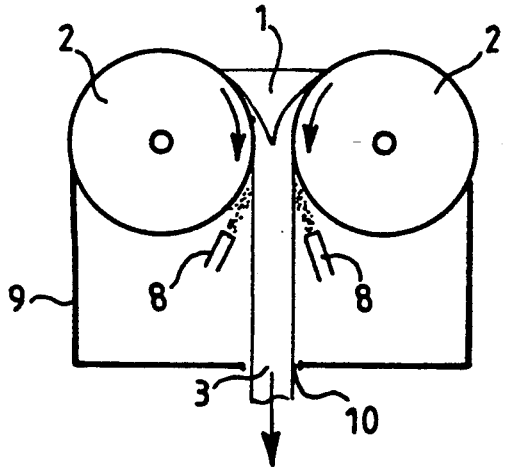
FIG. 2 is a diagrammatic and elevational view similar to FIG. 1, of a second embodiment of the device according to the invention.

The second embodiment of the device according to the invention (FIG. 2) comprises, in addition to the rolls 2, quenching means comprising nozzles 8 for blowing a liquefied inert gas onto the solidified strip 3 immediately upon its emergence from the casting space. These nozzles 8 are arranged in two rows placed below the rolls 2 on opposite sides of the strip in an arrangement similar to that of the nozzles 7 (FIG. 1). Indeed, the blowing outlets of the nozzles 8 are directed onto the opposed sides of the upper part of the strip 3 immediately after the strip comes away from the surface of the rolls 2. The inert gas may be for example argon or nitrogen employed in the liquid state so as to benefit from its vaporization upon contact with the solidified metal. This gas may be blown at a rate of for example 100,000 Ncm/h for a rate of travel of the strip 3 of about 1 m/s.

The device is advantageously completed by a case 9 diagrammatically represented, disposed below the ingot mould formed by the rolls 2, so dimensioned as to surround both the rows of nozzles 8 and the strip 3 and closed at its ends by means not shown. The case 9 defines at its lower end an opening 10 for the continuous extraction of the strip 3 in the direction toward an installation (not shown). It permits confining the gas blown onto the strip 3 over a sufficient length of a line to ensure the protection of the strip against surface oxidation by the surrounding air, added to the quenching achieved by the blowing of the inert gas through the nozzles 8.

Laboratory tests have been carried out for the stainless steel grade AISI 430 (standard ASTM A176) by means of an absolute dilatometer. A specimen of the metal was cooled within 2.5 s from 1,250° C. down to a temperature of 500° C. by the blowing of helium in the gaseous state in the furnace.

The structure of the specimen is ferritic and contains less than 1% martensite.

These tests have also confirmed the validity of the method according to the invention for attaining the desired object.

The metal obtained by the method and device according to the invention is easier to shear and coil at the output end of the casting line, owing to the quasi-total elimination of martensite in the ferritic matrix.

What is claimed is:

1. A method for manufacturing a semi-ferritic stainless steel strip from a bath of molten metal, said method comprising effecting a solidification of said metal in a continuous casting ingot mould comprising two cooled rolls rotating in opposite directions and disposed in confronting relation so as to define a casting space therebetween, continuously extracting a strip of solidified steel from said ingot mould, and, below said ingot mould, subjecting said strip to a quenching medium so as to rapidly cool said strip for a sufficient period of time to prevent formation of austenite.

2. A method according to claim 1, characterized in that said strip is cooled below the ingot mould just after the strip comes away from said cooled rotating rolls.

3. A method according to claim 1, comprising cooling said strip below said ingot mould at a minimum rate of 300° C./s, at least down to a temperature of about 500° C.

4. A method according to claim 1, comprising employing as said quenching medium a bath of molten alloy based on a metal which is at least one member selected from the group consisting of lead, tin and zinc, in which both a lower part of said rolls and an upper portion of said strip extracted from said ingot mold are immersed.

5. A method according to claim 1, comprising employing as said quenching medium a molten salt, and immersing a lower part of said rolls and an upper part of said strip in said quenching medium.

6. A method according to claim 5, wherein said molten salt is a mixture of $KNO_3$, $NaNO_2$ and $NaNO_3$.

7. A method according to claim 1, comprising employing as said quenching medium an inert gas cooled to a liquid state, and blowing said cooled inert gas onto an upper part of said strip on opposite sides of said strip and under said rolls just after said strip comes away from said rolls.

* * * * *